US006677908B2

(12) United States Patent
Strickland

(10) Patent No.: US 6,677,908 B2
(45) Date of Patent: Jan. 13, 2004

(54) MULTIMEDIA AIRCRAFT ANTENNA

(75) Inventor: Peter C. Strickland, Ottawa (CA)

(73) Assignee: EMS Technologies Canada, LTD, Ottawa (CA)

( * ) Notice: Subject to any disclaimer, the term of this patent is extended or adjusted under 35 U.S.C. 154(b) by 0 days.

(21) Appl. No.: 10/024,229

(22) Filed: Dec. 21, 2001

(65) Prior Publication Data

US 2002/0080084 A1 Jun. 27, 2002

Related U.S. Application Data

(60) Provisional application No. 60/256,936, filed on Dec. 21, 2000.

(51) Int. Cl.[7] ..... H01Q 1/28; H01Q 19/18

(52) U.S. Cl. ..... 343/705; 343/781 P; 343/837

(58) Field of Search ..... 343/837, 840, 343/781 P, 781 CA, 835, 836, 914, 916, 705, 755

(56) References Cited

U.S. PATENT DOCUMENTS

| | | | | |
|---|---|---|---|---|
| 2,458,885 A | * | 1/1949 | Warren | 343/835 |
| 3,147,479 A | * | 9/1964 | Williams | 343/840 |
| 3,739,392 A | * | 6/1973 | Ross et al. | 343/840 |
| 4,407,001 A | | 9/1983 | Schmidt | |
| 4,933,681 A | * | 6/1990 | Estang | 343/705 |
| 5,061,936 A | * | 10/1991 | Suzuki | 343/713 |
| 5,202,700 A | | 4/1993 | Miller | |
| 5,638,079 A | | 6/1997 | Kastner et al. | |
| 5,859,619 A | | 1/1999 | Wu et al. | |
| 5,905,463 A | | 5/1999 | Hannan | |
| 5,912,645 A | | 6/1999 | Wight et al. | |
| 5,929,819 A | | 7/1999 | Grinberg | |
| 6,049,312 A | | 4/2000 | Lord et al. | |
| 6,052,095 A | | 4/2000 | Ramanujam et al. | |
| 6,089,720 A | | 7/2000 | Sawai | |
| 6,107,973 A | | 8/2000 | Knop et al. | |
| 6,188,370 B1 | | 2/2001 | Lange | |
| 6,259,415 B1 | | 7/2001 | Kumpfbeck et al. | |
| 6,262,689 B1 | | 7/2001 | Yamamoto et al. | |
| 6,292,133 B1 | | 9/2001 | Lynch | |
| 6,310,584 B1 | | 10/2001 | Reece et al. | |
| 2001/0020914 A1 | | 9/2001 | Roederer | |
| 2001/0035842 A1 | | 11/2001 | Apostolos | |

FOREIGN PATENT DOCUMENTS

| | | |
|---|---|---|
| EP | 0277206 B1 | 8/1993 |
| WO | WO 97/35359 | 9/1997 |

OTHER PUBLICATIONS

"A High Aperture Efficiency, Wide–Angle Scanning Offset Reflector Antennas" —William P. Craig, IEEE Transactions on Antennas and Propagation, vol 41, No. 11, Nov. 1993, pp 1481–1490.

* cited by examiner

*Primary Examiner*—Michael C. Wimer
(74) *Attorney, Agent, or Firm*—Shapiro Cohen; Dennis R. Haszko

(57) ABSTRACT

An antenna system consisting of parabolic rectangular reflectors disposed contiguously in a linear array. The use of parabolic rectangular reflectors permits the reflectors to form a larger common rectangular aperture without gaps in illumination. The contiguous array of parabolic rectangular reflectors permits a lower profile which is ideal for use on an aircraft. Each parabolic rectangular reflector has its own feed system and each of the feeds are excited in phase. The combined radiation patterns of the parabolic reflectors produces a beam with a narrow width. This narrow beamwidth permits the system to communicate with one source while filtering out signals coming from other sources. In one embodiment, the antenna system may be mechanically steered in order to communicate with a transmitter and/or receiver whose relative position is continuously varying with respect to the antenna system.

11 Claims, 3 Drawing Sheets

MULTIMEDIA AIRCRAFT ANTENNA

This application relates to U.S. Provisional Patent Application No. 60/256,936 filed Dec. 21, 2000.

FIELD OF INVENTION

The present invention relates to the use of parabolic reflectors in an antenna system for use in broadband satellite communications. More specifically, the invention relates to an antenna array of parabolic rectangular reflectors having a low profile suitable for mounting on an aircraft.

BACKGROUND TO THE INVENTION

In the field of satellite communications, antenna systems for satellite communication are required to have a broad bandwidth while having a narrow antenna beam width. The broad bandwidth enables the antenna system to both transmit and receive signals over frequency bands of several GHz. The narrow antenna beam width provides a high gain for signals that are received and transmitted over a particular frequency to and from a particular satellite, and provides discrimination between satellites.

Although the antenna beam width is usually focussed on a particular satellite, it may also be necessary to alter the focus of the antenna beam toward another satellite.

Due to the high speed at which aircraft travel, antenna systems which are mounted on aircraft are required to maintain a low profile. The low profile minimizes drag. Typically, an antenna system is placed within a radome that has a height restriction in the range of 4 inches to 12 inches depending on the application type of aircraft.

Single parabolic reflectors are not ideal for use in applications requiring a low profile. This is due in part to the fact that a parabolic reflector has a low aspect ratio—it is difficult to optimally illuminate the entire reflector surface when the ratio of the aperture width to height is large. In order to illuminate the entire surface of the parabolic reflector, the reflector itself must be distanced from the reflector feed. For example, a parabolic reflector having a surface width of 28 inches would typically require the feed to be placed at least 10 inches from the reflector. This is well beyond the height restriction of the radome on an aircraft. Regardless of whether the feed is axial or offset, inside the radome, the geometry of a single parabolic reflector is less than ideal for use on an aircraft fuselage.

U.S. Pat. No. 5,929,819, issued to Grinberg, discloses a low profile antenna for satellite communications. Grinberg teaches the use of an array of antenna lenses for focussing guided and unguided waves to and from conventional antenna elements such as reflectors. Essentially, a number of antenna lenses are mounted overhead a corresponding number of antenna elements. Unfortunately, Grinberg would be impractical for placement inside a radome where height restrictions are a constraining factor.

In order to overcome the above shortcomings, the present invention seeks to provide an antenna system where a number of parabolic reflectors are contiguously disposed in a linear array. The antenna system would be small enough to fit within a radome, such that the physical dimensions and profile would minimally affect the drag on the aircraft. Furthermore, the antenna system seeks to provide high gain and a narrow beam width to support high data rates and provide adjacent satellite discrimination.

SUMMARY OF THE INVENTION

The present invention seeks to provide an antenna system consisting of parabolic rectangular reflectors disposed contiguously in a linear array. The use of parabolic rectangular reflectors permits the entire composite rectangular aperture to be excited without gaps in illumination. The parabolic rectangular reflectors permit a lower profile which is ideal for use on an aircraft. Each parabolic rectangular reflector has its own feed system and each of the feeds are excited in phase. The combined radiation patterns of the parabolic reflectors produce a beam with a narrow width. This narrow beamwidth permits the system to communicate with one source while filtering out signals coming from other sources. In one embodiment, the antenna system may be mechanically steered in order to communicate with a transmitter and/or receiver whose relative position is continuously varying with respect to the antenna system.

In one aspect, the present invention provides an antenna system including:

a common aperture surface;

at least two parabolic rectangular reflectors, each parabolic rectangular reflector having a concave surface, a long side and a short side providing a rectangular aperture, each parabolic rectangular reflector being disposed contiguously in a linear array defined by a linear axis forming a larger common rectangular aperture without gaps in illumination, each of the at least two parabolic rectangular reflectors having a corresponding reflector feed and the concave side of each of the at least two parabolic rectangular reflectors facing the reflector feed; and a power splitting and combining means for feeding input power to each reflector feed;

wherein each of the at least two parabolic rectangular reflectors is supported by the common surface between the at least two parabolic rectangular reflectors and the corresponding reflector feeds and wherein the long side of each parabolic rectangular reflector is parallel to the linear axis of the linear array.

BRIEF DESCRIPTION OF THE DRAWINGS

The invention will now be described with reference to the drawings, in which.

DETAILED DESCRIPTION

Figure 1:
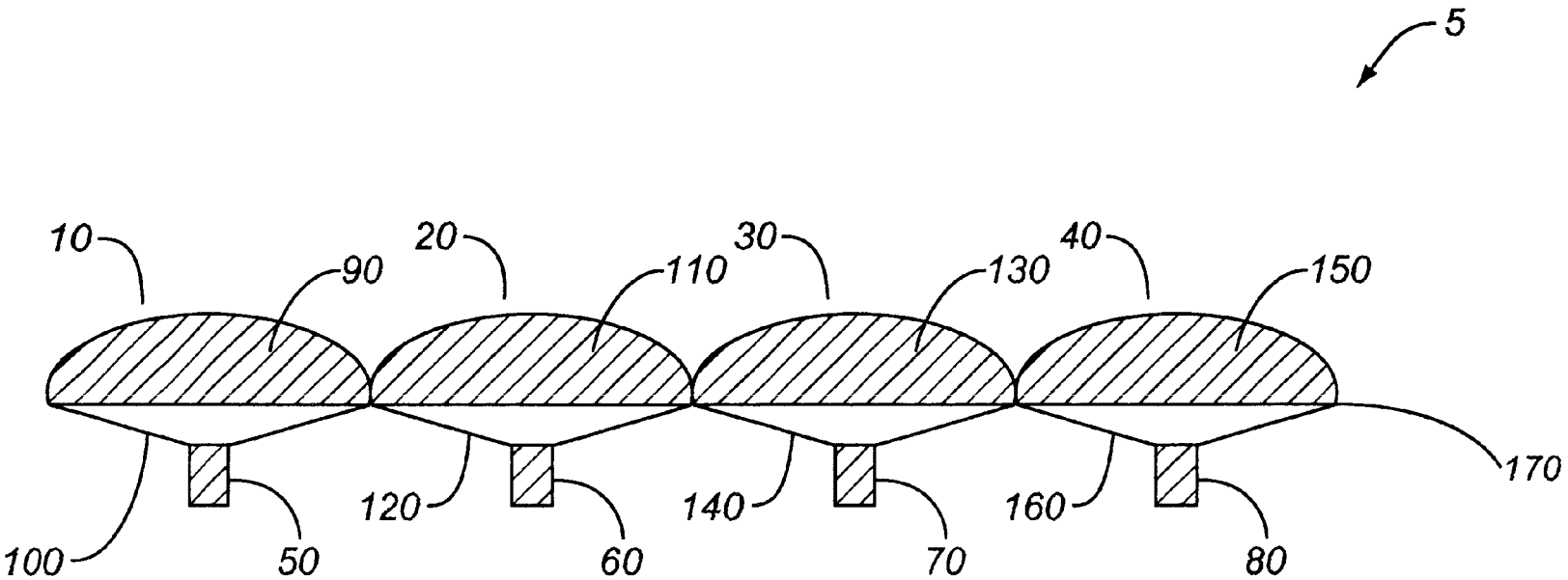
FIG. 1 shows a side view of the antenna system according to the present invention.

FIG. 1 illustrates a side view of the antenna system 5 according a first embodiment to the present invention. According to this first embodiment, the antenna system 5 consists of four antenna elements 10, 20, 30, 40, and four antenna element feeds 50, 60, 70, 80, respectively. The antenna elements are identical. The antenna element 10 is comprised of a rectangular parabolic reflector 90 and a support strut 100. The antenna element 20 has both a rectangular parabolic reflector 110 and a support strut 120. The antenna element 30 has both a rectangular parabolic reflector 130 and a support strut 140. Finally, the antenna element 40 has both a rectangular parabolic reflector 150 and a support strut 160. Although there are four antenna elements shown, the antenna system, in accordance with the present invention, may have at least two antenna elements.

It should be further explained that the rectangular parabolic reflectors 90, 110, 130, 150 have a rectangular side edge configuration. The rectangular parabolic reflector differs from the conventional parabolic reflectors which have a circular or an elliptical edge configuration. The rectangular edge configuration permits the parabolic reflectors 90, 110, 130, 150, to be adjacent without gaps forming a larger common rectangular aperture. The contiguous disposition of the parabolic reflectors 90, 110, 130, 150 is one factor which contributes to an optimal illumination of the antenna array and to the antenna system 5 having a low profile. Although all the side edges of the parabolic reflector are straight, the outer corners of the reflectors at the ends of the array may be rounded. A rounded edge may enable the antenna system to fit into a smaller aircraft mounted radome.

The support struts 100, 120, 140, 160 are support members for the feeds. However, the support struts are non-essential elements in that the feeds may be attached to the reflectors by other means. The support struts 100, 120, 140, 160 are designed to provide for minimal blockage of the paraboloidal apertures so as not to interfere with the element feeds 50, 60, 70, 80.

The element feeds 50, 60, 70, 80 each transmit a guided wave deriving, for instance, from a coaxial cable. Alternatively, the element feeds receive an unguided wave propagating through space. An unguided wave reflects off the parabolic reflector surface and would then be received at the element feed. To transmit a guided wave, each element feed is excited in phase through a power splitting/combining means, shown in FIG. 3. As each element feed is excited, the combined radiation pattern of the antenna elements produces a narrow beam.

The "front" of each parabolic reflector 90, 110, 130, 150 forms part of the common surface 170. The concave surface of each parabolic reflector 90, 110, 130, 150 faces the common surface 170. This common surface 170 enables the rectangular parabolic reflectors to form a continuous antenna aperture in order to further narrow and focus the antenna beam.

Figure 2:
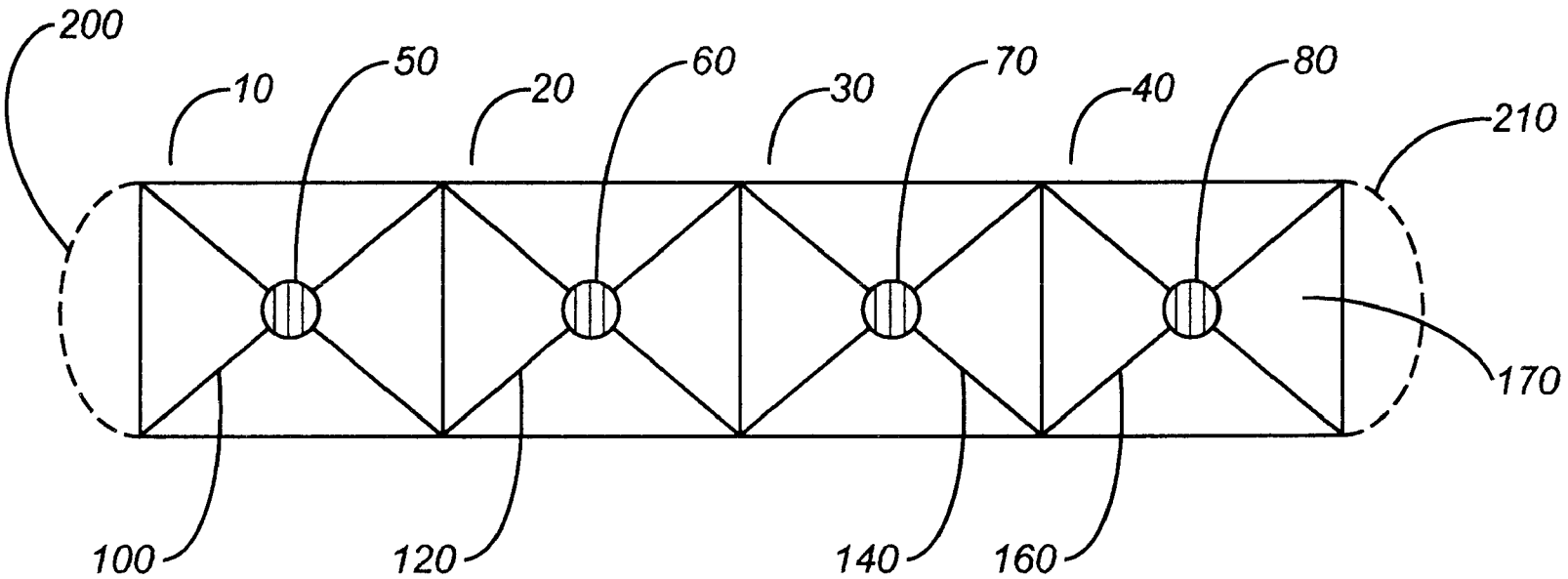
FIG. 2 illustrates a bottom view of the antenna system of FIG. 1 according to the present invention.

FIG. 2 illustrates a bottom view of the antenna system 5 described in FIG. 1. In FIG. 2, the common surface 170 is attached to each of the support struts 100, 120, 140, 160 each of which are attached to the element feeds 50, 60, 70, 80. Although the common surface is rectangular, the dashed lines 200, 210 illustrate that the outer edges of the parabolic reflectors belonging to antenna elements 10, 40 may be curved.

Figure 3:
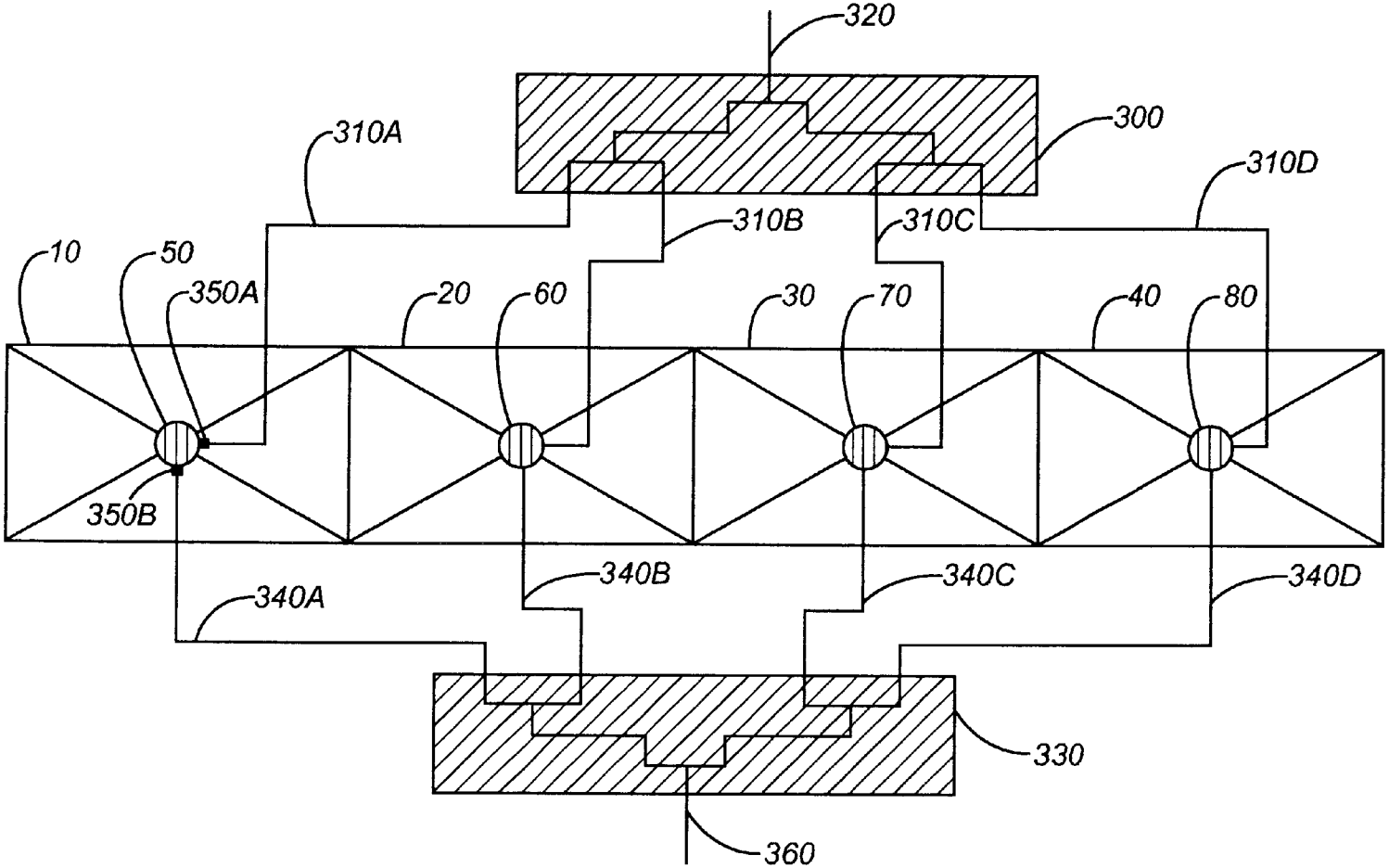
FIG. 3 shows a bottom view of the antenna system of FIG. 1, further including a power splitter/combiner, according to the present invention.

FIG. 3 illustrates the antenna system 5 of FIGS. 1 and 2 in combination with a power splitter/combiner. In FIG. 3, the power splitter/combiner is shown as two separate elements, although they may be one element. The power divider 300 has four connections 310A, 310B, 310C, 310D, which are connected to the antenna feeds 50, 60, 70, 80, respectively. The four connections 310A, 310B, 310C, 310D may be a coaxial cable or any other suitable connecting means. The power divider 300 also has an input beam port 320. The use of four connections 310A, 310B, 310C, 310D enables the antenna system 5 to form an antenna beam which utilizes all of the parabolic reflectors.

The power combiner 330 also has four connections 340A, 340B, 340C, 340D, each of which are connected to antenna feeds 50, 60, 70, 80, respectively. The antenna feeds each have two connections. The antenna feed 50 is attached to the power combiner 330 through a connection 340A and to the power splitter 300 through a connection 310A. The antenna feed 60 is attached to the power combiner 330 through a connection 340B and to the power splitter 300 through a connection 310B. The antenna feed 70 is attached to the power combiner 330 through a connection 340C and to the power splitter 300 through a connection 310C. Accordingly, the antenna feed 80 is attached to the power combiner 330 through a connection 340D and to the power splitter 300 through a connection 310D.

Also, each antenna feed 50, 60, 70, 80 has two connections which are attached at respective input/output ports. In FIG. 3, the antenna feed 50 has an input port 350A which is coupled to the connection 310A and in turn connected to the power splitter 300. The power splitter sends a signal and the required input power to the antenna feed 50. The antenna feed 50 has an output port 350B which is coupled to the connection 340A and in turn connected to the power combiner 330. There may be more than one output port at each antenna feed. Each output port represents a particular horizontal or vertical polarisation. The horizontal and vertical polarisation permits the antenna feeds 50, 60, 70, 80 to excite the antenna elements at various phases. As such, through the appropriate phase and amplitude combining of each of the element feeds 50, 60, 70, 80, the antenna elements 10, 20, 30, 40 may be excited in combination such that they produce an antenna beam that may be focussed in various directions. With use of a Blass Matrix, which is well-known in the art of antenna engineering, various antenna beams could be produced in any number of directions.

While FIG. 3 only shows two connections to each element feed 50, 60, 70, 80, there may be more than one output connection to the power combiner 330. Each additional output connection would be coupled to a separate power combiner. Each additional power combiner would also be connected to the main transceiver equipment located on the aircraft. In a dual-band system each element feed would have four connections corresponding to a horizontal and a vertical polarisation for each of the two bands.

Also, an output beam port 360 is connected to the power combiner 330. Both the input beam port 320 and the output beam port 360 may be coupled to the aircraft transceiver equipment that uses the antenna system.

In an alternative embodiment, the antenna system 5 of FIGS. 1 and 2 may be mechanically steered. The antenna system 5 could be steered in one or more planes in order to track a transmitted and/or received signal whose relative position is varying. Such mechanical steering could be performed through use of a drive pulley system used to either rotate the antenna feeds or their corresponding element feeds.

For protective purposes, the antenna system of the present invention may be placed within a radome shaped and sized to match the antenna system. The size and shape of the radome should have minimal effects on the drag of the aircraft.

Although the antenna system is advantageous for use on an aircraft, the present invention also lends itself to applications on vehicles on the ground that are in communication with satellites.

What is claimed is:

1. An antenna system including:

a common aperture surface;

at least two parabolic rectangular reflectors, each parabolic rectangular reflector having a concave surface, a long side and a short side providing a rectangular aperture, each parabolic rectangular reflector being disposed contiguously in a linear array defined by a linear axis and forming a larger common rectangular aperture without gaps in illumination, each of the at least two parabolic rectangular reflectors having a corresponding reflector feed and the concave surface of each of the at least two parabolic rectangular reflectors facing the reflector feed; and a power splitting and combining means for feeding input power to each reflector feed;

wherein each of the at least two parabolic rectangular reflectors is supported by the common surface between the at least two parabolic rectangular reflectors and the corresponding reflector feeds and wherein the long side of each parabolic rectangular reflector is parallel to the linear axis of the linear array.

2. A system as defined in claim 1, wherein each of the at least two parabolic reflectors has at least one corresponding support strut located between the common surface and the corresponding reflector feed.

3. A system as defined in claim 1, wherein each reflector feed is connected separately to both a power splitting means and a power combining means.

4. A system as defined in claim 3, wherein each reflector feed is further connected to at least one power combining means.

5. A system as defined in claim 1, wherein at least one of the short sides of the parabolic rectangular reflector located at the end of the linear array is rounded.

6. A system as defined in claim 1, wherein the common aperture formed by the contiguous parabolic reflectors is rotatable in one or more planes.

7. A system as defined in claim 1, wherein the antenna system has an airborne application.

8. A system as defined in claim 1, wherein the system is mounted on an aircraft for use in satellite communications.

9. A system as defined in claim 8, wherein the antenna system is placed within a radome which is mounted on the aircraft.

10. A system as defined in claim 1, wherein the system is mounted on a ground vehicle for use in satellite communications.

11. A system as defined in claim 1, wherein an outer one of the short sides of the parabolic rectangular reflector located at each end of the liner array is rounded.

* * * * *